US005090582A

United States Patent [19]

Art et al.

[11] Patent Number: 5,090,582

[45] Date of Patent: Feb. 25, 1992

[54] BOTTLE CAP

[75] Inventors: Gregory R. Art, Saugus; Frank M. Podsiadlik, Huntington Beach; Albert Lackland, Canyon Country, all of Calif.

[73] Assignee: Baxter International Inc., Deerfield, Ill.

[21] Appl. No.: 598,316

[22] Filed: Oct. 16, 1990

[51] Int. Cl.[5] ..... B65D 53/04

[52] U.S. Cl. ..... 215/250; 215/226; 215/228; 215/257; 215/295; 220/258; 220/267; 220/278

[58] Field of Search ..... 215/228, 250, 295, 226, 215/302, 303, 257; 220/212, 258, 265, 277, 278, 267

[56] References Cited

U.S. PATENT DOCUMENTS

| | | | |
|---|---|---|---|
| 1,100,433 | 6/1914 | Johnson . | |
| 2,062,182 | 11/1936 | Kubitz | 220/278 X |
| 2,152,001 | 4/1938 | Temple . | |
| 2,365,524 | 5/1942 | Court . | |
| 2,592,806 | 3/1947 | Jeffery . | |
| 3,109,562 | 9/1954 | Ferris . | |
| 4,340,147 | 7/1982 | McIntosh . | |
| 4,634,013 | 1/1987 | Bar-Kokhba . | |
| 4,678,098 | 7/1987 | Oka . | |
| 4,709,822 | 12/1987 | Vataru | 215/216 |
| 4,747,501 | 5/1988 | Greaves | 215/253 |
| 4,792,053 | 12/1988 | Towns et al. | 215/250 |
| 4,793,122 | 12/1988 | Towns et al. | 53/421 |
| 4,793,503 | 12/1986 | Towns et al. | 215/250 |
| 4,793,505 | 12/1988 | Towns et al. | 215/250 |
| 4,898,293 | 2/1990 | Morel . | |

*Primary Examiner*—Stephen Marcus
*Assistant Examiner*—Stephen Cronin
*Attorney, Agent, or Firm*—Kay H. Pierce; Paul C. Flattery

[57] ABSTRACT

A bottle cap having a cutting means located inside the cap for selectively opening a sealed bottle is described. The cap can be rotated in either direction over the seal to cause the seal to be punctured and to cause a "C"-shaped cut in the seal. In the preferred embodiment, the center of the "C"-shaped cut portion of the seal is dragged away from the center of the mouth of the bottle, and a portion of the linear remains uncut as the cap is rotated to prevent the liner from dropping down into the bottle.

8 Claims, 3 Drawing Sheets

BOTTLE CAP

TECHNICAL FIELD

The invention relates generally to opening systems and more specifically to systems for opening the mouths of liner-sealed containers.

BACKGROUND ART

In many circumstances, a person may desire to open a bottle that is sealed with a liner such as a foil liner without the person's hands coming in contact with the liner or the material inside. For instance in the medical field, it may be necessary to open a bottle containing a sterile fluid that is sealed with a foil liner without compromising the sterility of the fluid. If the bottle is to be opened in an operating room environment and the person opening the bottle is wearing gloves, it may be very difficult to open the foil-sealed bottle.

In some instances, it may also be very important that the foil liner not contact or break off and fall into the contents of the bottle after it has been punctured. In other instances, it may be very important to be able to push the portion of the foil liner after it has been punctured away from the opening to create an adequately-sized pour orifice.

Similar needs exist in many other types of applications outside the medical field. For instance, in the automotive field, a foil-sealed bottle may contain very caustic solutions which could be very harmful if they came in contact with the skin of a person opening the bottle. Accordingly, it may be important to be able to provide a convenient and simple way of opening such a bottle. It may also be very important to be able to reseal the bottle if it is not completely emptied after use. Therefore, a need exists to provide a simple means of opening a foil-sealed bottle and of re-sealing the bottle after use. One can easily imagine many such other applications in which foil-sealed bottles may need to be opened and subsequently re-sealed.

Various devices which have been used in the past to open such bottles include caps which contain a puncturing device located in the center of the cap. The cap may be screwed onto a bottle to force the puncturing device into the center of a foil liner. Such a puncturing device can create a single hole approximately the same size as the circumference of the puncturing device. If the puncturing device is small, it may be difficult to dispense the contents from the bottle. If the puncturing device is large, the act of puncturing the liner may cause pieces of the liner to break off and drop into the bottle or drop into the fluid as it is being poured out of the bottle. Numerous other types of devices such as "can opener" type devices and "spikes" have been also used in the past to open foil-sealed bottles.

One of the problems with many of the devices used in the past was that there was no foolproof method of making sure that the opening created in the foil was sufficiently large enough to meet the needs of the user without also possibly allowing portions of the foil to break off or fall into the bottle as it was opened. Another problem with some systems used in the past was that such systems required additional apparatus, such as a can opener, to open the bottle. Yet another problem with some bottle opening systems was that there was no method for maintaining the sterility of the contents of the bottle as it was opened. These and other problems are all addressed by the invention described below.

SUMMARY AND OBJECTIVES OF THE INVENTION

It is an object of the invention to provide a system for opening foil-sealed bottles.

It is another object of the invention to provide a system for opening a foil-sealed bottle which does not require additional apparatus supplied either by the manufacturer or user of the bottle.

It is yet another object of the invention to provide a system for opening a foil-sealed bottle which is relatively simple and inexpensive to manufacture.

It is also an object of the invention to provide a system for opening a foil-sealed bottle that is not complicated to use.

It is yet another object of the invention to provide a system for opening a foil-sealed bottle which forces the opened portion of the foil out of the way to create an adequately-sized pour orifice.

It is also an object of the invention to provide a bottle cap which can both open a foil-sealed bottle and reseal the bottle after it has been opened.

It is another object of the invention to provide a bottle cap having an opener to selectively open a portion of a foil liner of a bottle in which the foil liner remains intact and does not fall into the bottle.

The invention can be briefly described as a bottle cap for opening a bottle that has threads in which the bottle orifice is sealed with a liner. The cap includes a cylinder that has an inner surface. A partition divides the cylinder into upper and lower sections. The partition has upper and lower surfaces. The bottle cap also includes a threaded means for securing the cap to the threaded bottle. The threaded means is located on the inner surface of the cylinder in the lower section. Also included in the invention is a puncture means for circumferentially puncturing the liner as the upper section Of the cap is pressed against the mouth of the bottle and is rotated over the orifice. The shape of the puncture means is such that as the cap is rotated and the liner is being cut, the puncture means causes the cut portion of the liner to be pushed toward the uncut portion of the liner causing a large "C"-shaped pour orifice to be formed. The puncture means is located on the upper surface of the partition. Finally, the invention also includes a ramp means for contacting the threads of the upper section of the cap as the cap is rotated over the orifice. The ramp means causes the puncture means to selectively disengage from the liner to prevent puncturing a circumferential portion of the liner. Thus, as the cap is rotated over the liner, a "C"-shaped incision is created in the liner, and the center portion of the liner is displaced, thus, creating a pour orifice without the risk of detachment of the liner from the mouth of the bottle.

DETAILED DESCRIPTION OF THE PREFERRED EMBODIMENT

Figure 1:
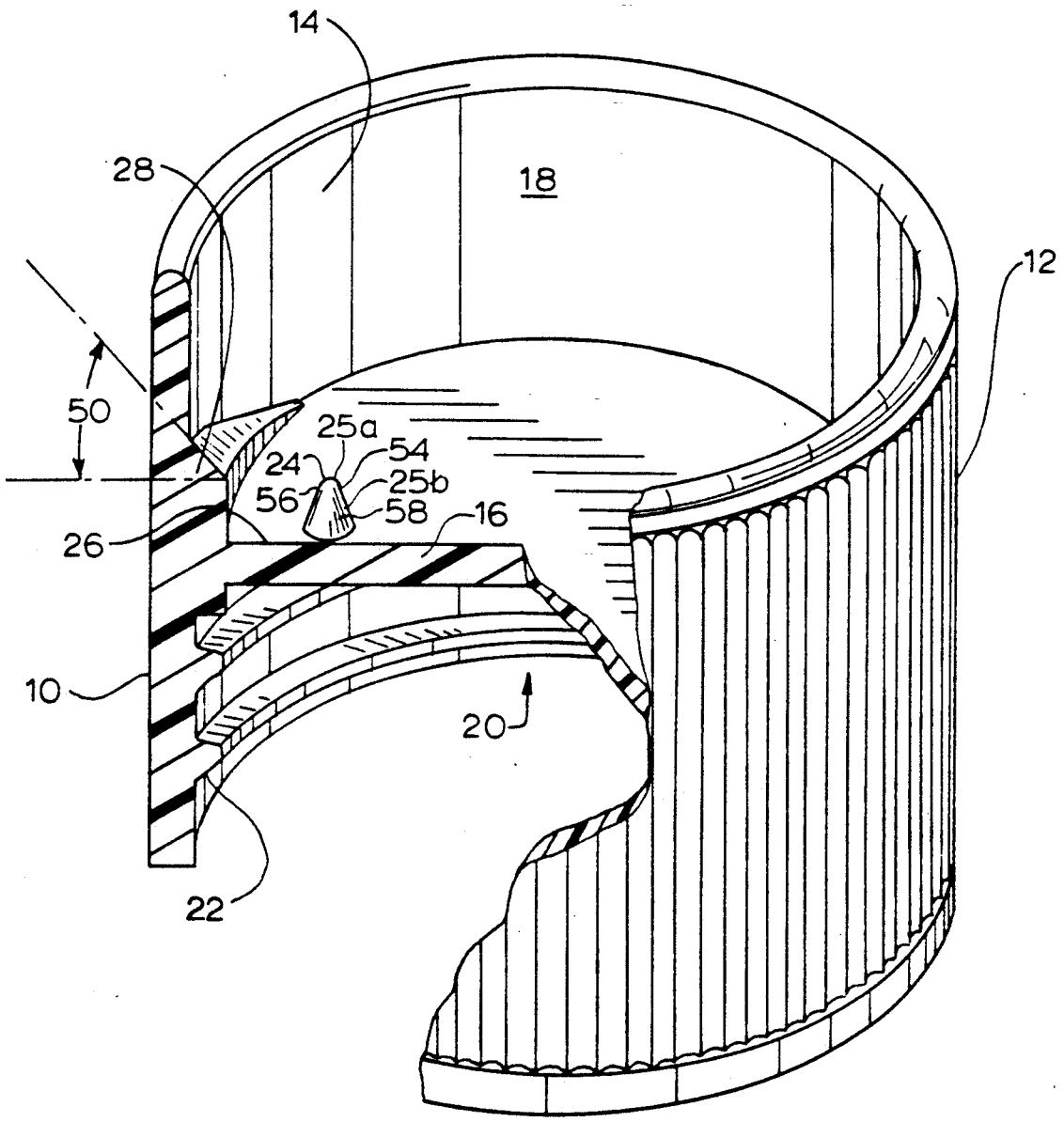
FIG. 1 is a partially broken away side view of the preferred embodiment of the subject invention.

Refer now to FIG. 1 which illustrates the currently preferred embodiment of the invention. In this figure, a bottle cap 10 includes a cylinder 12 having an inner surface 14. A partition 16 is provided that divides the cylinder 12 into an upper section 18 and a lower section 20. A threaded means 22 is provided on the inner surface 14 of the lower section 20 to secure the cap 10 onto a threaded bottle.

The cap 10 also includes a puncture means 24 for circumferentially puncturing a liner of the bottle as the upper section 18 of the cap 10 is rotated over the orifice of the bottle. The puncture means 24 is located on the upper surface 26 of the partition 16.

Figure 2:
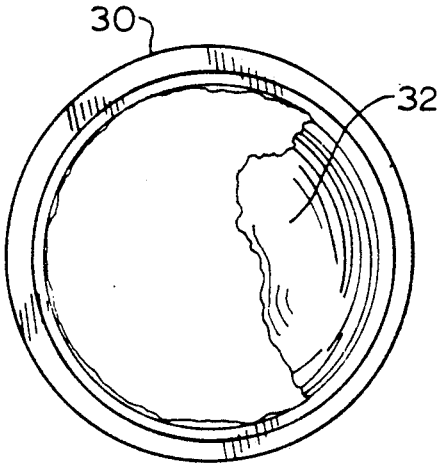
FIG. 2 is a top view of a bottle illustrating a foil liner after it has been opened.

The cap 10 also includes a ramp means 28 for contacting the threads of a bottle as the upper section 18 of the cap 10 is rotated over the bottle's orifice. The ramp means 28 causes the puncture means 24 to disengage from the liner of the bottle to selectively prevent the puncture means 24 from circumferentially cutting the entire liner. This is more clearly illustrated in FIG. 2 which is a top view of a bottle 30 with a foil liner 32 after it has been cut. As can be seen in the figure, as the cap 10 is rotated over the orifice, a "C"-shaped opening is created.

Figure 3:
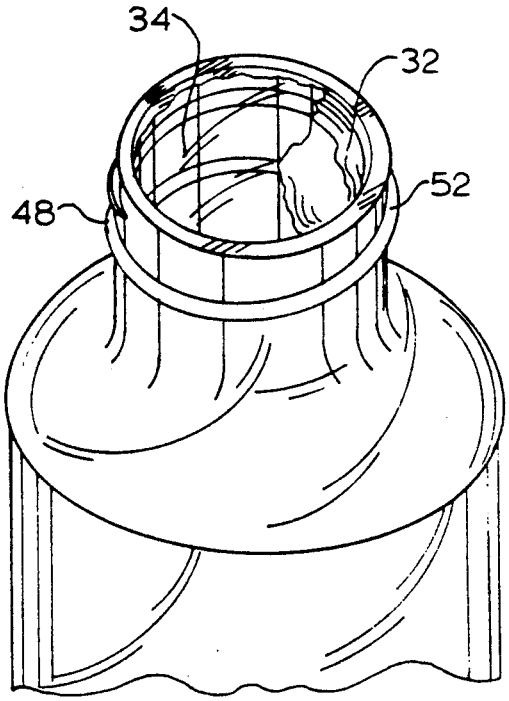
FIG. 3 is a perspective view of the bottle illustrating a foil liner that is pushed away to create a pour orifice.

In the preferred embodiment of the invention as illustrated in FIG. 3, the foil liner 32 is actually pushed away from the opening 34 to create a pour orifice. The exact mechanism which causes the foil liner 32 to be pushed away from the opening is not totally understood by the applicants at this time. However, it appears to be dependent upon the mechanical characteristics of the foil liner 32 to be punctured and the dimensions of the puncture means 24. For instance, if the foil liner 32 is too brittle or stiff, this pulling effect will not occur and an adequate pour orifice 34 will not be created. Also, the characteristics of the puncture means 24 can impact the final configuration of the cut liner. The puncture means 24 actually consists of a puncture point 25(*a*) and a cutting surface 25(*b*). In general, the puncture point 25(*a*) needs to be sufficiently 10 sharp to create an initial "clean" puncture of the liner 32. While conversely the cutting surface 25(*b*) should be sufficiently dull to drag or pull the foil liner to one side of the bottle as the cap 10 is rotated. If the liner 32 is sufficiently malleable and the cutting surface 25(*b*) is sufficiently dull, it is not necessary to use a ramp means 28 to disengage from the liner to produce the desired "C"-shaped orifice. It is preferred to have a foil liner 32 which has some malleability and to have a puncture means 24 that is sufficiently dull to cause a degree of tearing or drag to occur as the cap 10 is rotated. This tearing or drag is preferred rather than precise cutting because it causes the foil liner 32 to be pushed away from the center of the orifice of the bottle as the cap 10 is rotated.

Another important aspect of the invention is the relationship and size of the puncture means 24 relative to the ramp means 28. This relationship is more clearly illustrated in FIG. 4. However, before this relationship can be easily understood, it is necessary to describe in more detail the particular shape of the puncture means 24 and the ramp means 28.

The ramp means 28 in the preferred embodiment includes a first protrusion 36 that extends outwardly from the inner surface 14 of the cylinder 12 onto the upper surface 26 of the partition 16. In the preferred embodiment of the invention, the first protrusion 36 includes a first wall 38 that is parallel to the inner surface 14 of the cylinder 12. The first protrusion 36 also includes second and third walls 40,42 which extend angularly outward from the inner surface 14 to the first wall 38. The second and third walls 40,42 have an angle with respect to one another in the preferred embodiment. The size of the angle depends on the rate at which it is desired to cause the puncture means 24 to engage and disengage from the foil liner 32. If the angle is very narrow, the puncture means 24 will rapidly engage and disengage from the foil liner 32 as the cap 10 is rotated. On the other hand, if the angle is very wide, the puncture means 24 will gradually engage and disengage from the foil liner 32. In the preferred embodiment, the angle may range from 67 to 135 degrees. In the currently preferred embodiment, the angle is 90 degrees.

In the preferred embodiment, the first protrusion 36 which forms the ramp means 28 also includes a fourth wall 44. The fourth wall 44 extends along an edge 46 of the first wall 38 that is parallel to the upper surface 26. The fourth wall 44 extends from the first wall 38 to the inner surface 14 of the cylinder 12. The purpose of the fourth wall 44 is to create a contact surface between the ramp means 28 and the upper most portion of the threads 48 of a bottle.

In the preferred embodiment of the invention the fourth wall 44 extends at a thread angle 50 (FIG. 1) which is generally equal to an angle 52 on the threads 48 of the bottle. The purpose of having a fourth wall 44 with a thread angle 50 that is substantially equal to the angle 52 on the threads 48 is to maximize the contact between the ramp means 28 and the bottle threads 48. This ensures that the cap 10 will ride up on the threads 48 as the cap 10 is rotated thus disengaging the puncturing means 24 from the foil liner 32.

Figure 7:
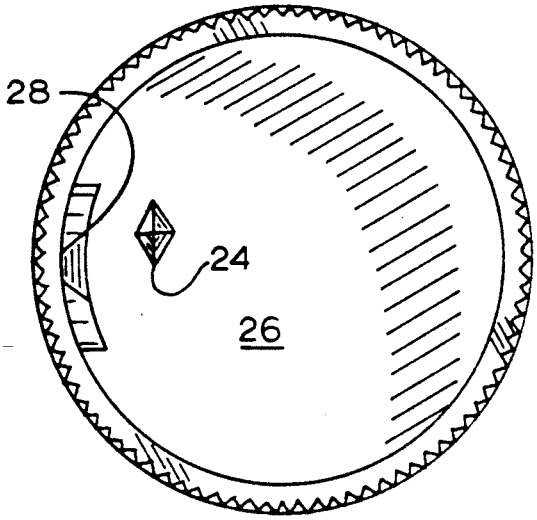
FIG. 7 is a top view of an alternative embodiment of the invention.

The puncture means 24 of the preferred embodiment includes a second protrusion 54 that is clearly illustrated in FIG. 1. The second protrusion 54 extends outwardly from the upper surface 26 of the partition 16. In the preferred embodiment, the second protrusion 54 includes a cutting surface 56 fVr contacting and cutting the foil liner 32. Also in the preferred embodiment, the second protrusion 54 is in the shape of a cone 58 with the cutting surface 25(*b*) located-along the wall of the cone 58. In other embodiments, the second protrusion 54 may be in the shape of a diamond (as illustrated in FIG. 7) or any other shape which will allow the second protrusion 54 to puncture and cut the foil liner 32.

Figure 4:
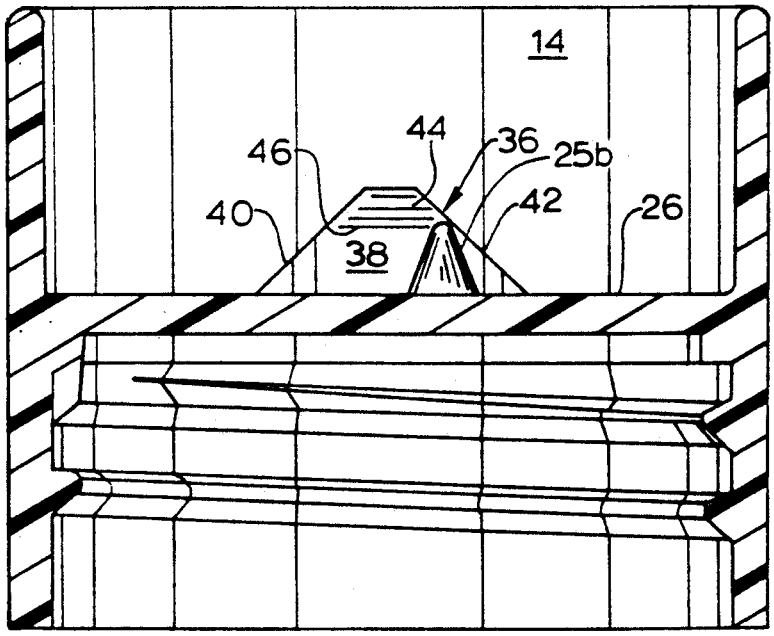
FIG. 4 is a sectional view of the invention illustrating the relationship between the ramp means and the puncture means of the cap.

As illustrated in FIG. 4, in the preferred embodiment of the invention, the relationship of the ramp means 28 with respect to the puncture means 24 is critical. Specifically, the fourth wall 44 of the ramp means 28 is at a greater height than the height of the puncture point 25(*a*) with respect to the partition 16. The relative heights of the fourth wall 44 and the cutting surface 56 ensure that the cutting surface 56 will disengage from a circumferential portion of the foil liner 32 as the cap 10 is rotated over the foil liner 32.

The cap 10 described above can be easily used to open a foil-sealed container. In the preferred embodiment, the cap 10, is shipped to a user with the lower section 20 screwed on to the threads 48 of a bottle 30. The user simply unscrews the cap 10 from the bottle 30 and inverts the cap 10 to cause the upper section 18 to be placed over the foil liner 32. The user then forces the puncture means 24 into the foil liner 32 and rotates the cap 10 at least 360 degrees in either direction to cause the ramp means 28 to ride along the upper-most thread 48 of the bottle 30 to cause the puncture means 24 to circumferentially puncture a "C"-shaped portion of the foil liner 32.

Figure 5:
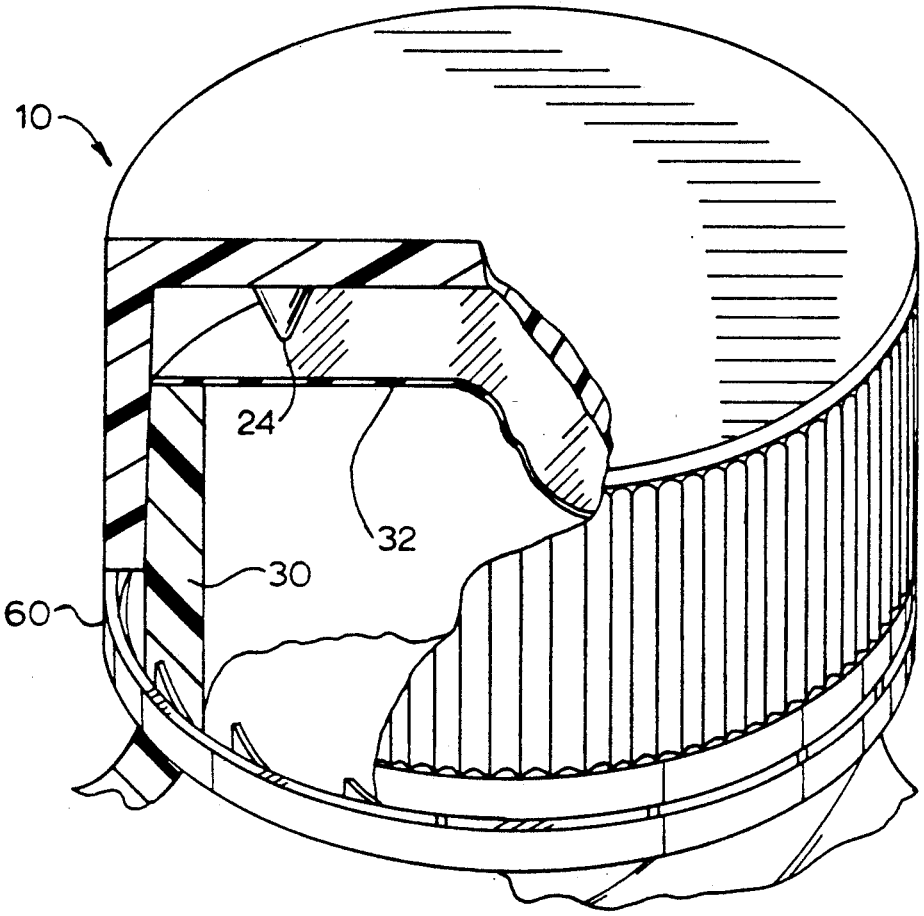
FIG. 5 is a perspective view of one embodiment of the invention in which the puncture means is in juxtaposition to the foil liner.

In other embodiments of the invention, it may be desirable to provide the user with only the portion of the cap that contains the puncture means and not the portion of the cap that contains the threads. This may be desirable when it is not necessary to screw the cap onto the bottle after the bottle has been opened. In such instances, it may be desirable to ship the bottle 30 to a user with the "upper" section 18 of the cap 10 inverted so that it is in juxtaposition to the foil liner 32. This embodiment is illustrated in FIG. 5. In this embodiment, a tear-away tab 60 is used to maintain the cap 10 in position over the liner 32 until it is desired to puncture the liner 32. The tab 60 can be removed immediately prior to puncturing the liner 32 to allow the puncturing means 24 to puncture the liner 32.

In the medical field, and in other fields in which it is desired to maintain the sterility of the contents of any fluids in the bottle 30, the bottle 30 and cap 10 may be shipped to a user inside a sterile package. The sterile package may also include sterile gloves which the user may don prior to handling the bottle 30 or the cap 10. The user then may remove the bottle 30 and cap 10 from the sterile container and open the bottle 30 as described above. Since the cap 10 can be easily handled and centered over the orifice of the bottle 30, the preferred embodiment of the invention provides a simple way for a user to open a bottle 30.

Figure 6:
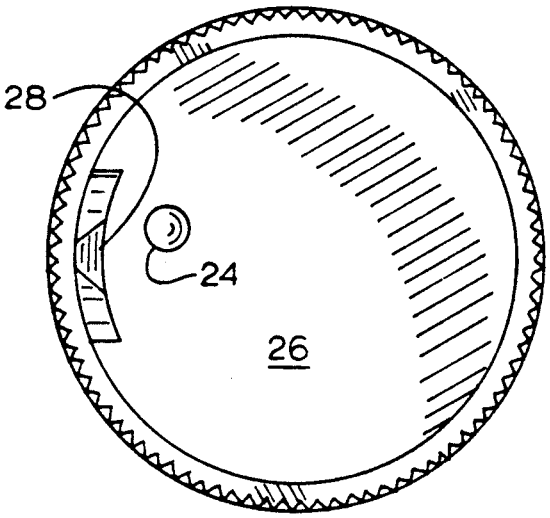
FIG. 6 is a top view of the currently preferred embodiment of the invention.

In the preferred embodiment of the invention as illustrated in FIG. 6, the relationship of the location of the puncture means 24 with respect to the ramp means 28 is also important. As can be seen in FIG. 6, the puncture means 24 can be located off center from the upper surface 26 of the partition 16. However, the puncture means 24 should be located in close proximity to the ramp means 28 to allow the puncture means 24 to create as large of an opening in the foil liner 32 as possible. Generally, the puncture means should be located between the outside dimensions of the ramp means. If this is not the case, the ramp means will not prevent the puncture means from cutting around the entire circumference of the liner.

It is also important in the preferred embodiment of the invention to ensure that the inside diameter of the cylinder 12 is only slightly larger than the outside diameter of the bottle threads 48, and, it is also important that the upper section 18 have a height that is generally equal to or longer than the height of the threaded portion of the bottle neck. This reduces any instability of the cap 10 as it is rotated.

Finally, it is important to understand that a unique aspect of the invention is that the bottle cap 10 can be rotated in either direction over the bottle to cause the ramp means 28 to ride on the threads 48 of the bottle. It does not matter which direction the cap 10 is rotated; the puncture means 24 will always engage and disengage from the foil liner 32 at the same locations to create a "C"-shaped cut in the liner. The exact location of engagement and disengagement being dictated by the distance of the uppermost thread 48 from the top of the bottle. When the uppermost thread 48 is at its closest to the top of the bottle, the ramp means 28 will cause the puncture means 24 to move away from the foil liner as the cap 10 is rotated. Thus, that portion of the liner 32 closest to the uppermost portion of the threads 48 will not be punctured regardless of which way the cap is rotated.

We claim:

1. A bottle cap for opening a bottle having a mouth having an edge which is sealed with a liner, comprising:

a cylinder having an inner surface;

a partition dividing said cylinder into an upper and lower section said partition having an upper and lower surface;

threaded means for securing said cap to said threaded bottle, said threaded means being located on said inner surface of said cylinder on said lower section;

puncture means for circumferentially puncturing a "C"-shaped portion of the liner and causing the C-shaped portion of the liner to be pulled toward said edge of the mouth as said upper section of said cap is rotated over the mouth, said puncture means being located on said upper surface of said partition, ramp means for contacting the threads as said upper section of said cap is rotated over the mouth to cause said puncture means to refrain from puncturing a portion of the circumference of the liner wherein said ramp means includes a first protrusion extending outwardly from said inner surface of said cylinder onto said upper surface of said partition wherein said first protrusion includes:

a first wall parallel to said inner surface of said cylinder; and second and third walls extending from said inner surface to said first wall, said second and third walls having an angle with respect to one another, a fourth wall extending along an edge of said first wall that is parallel to said upper surface, said fourth wall extending from said first wall to said inner surface of said cylinder, and wherein said puncture means further includes a second protrusion extending outwardly from said upper surface of said partition.

2. A bottle cap as recited in claim 1 wherein said fourth wall extends at a thread angle with respect to said partition, said thread angle being generally equal to an angle on the threads of the bottle.

3. A bottle cap as recited in claim 2 wherein said second protrusion further includes:

a puncture point for initially puncturing the liner; and a cutting surface for cutting the liner as said cap is rotated about the mouth.

4. A bottle cap as recited in claim 3 wherein said fourth wall is at a greater height than the height of said cutting surface with respect to said partition to cause said cutting surface to disengage from a circumferential portion of the liner as said upper portion of said cap is rotated over the liner.

5. A bottle cap as recited in claim 4 wherein said second protrusion is cone shaped.

6. A bottle cap as recited in claim 5 wherein said second protrusion is diamond shaped.

7. A material containment system, comprising:

a bottle having an orifice, said bottle also having a neck having threads disposed about said orifice;

a liner sealing said orifice; and a cap having a cylinder having an inner surface, said cap also having a partition dividing said cylinder into upper and lower sections, said partition having upper and lower surfaces, said cap also having a puncture means for circumferentially puncturing said liner, said cap also having ramp means for contacting said threads to cause said puncture means to disengage from a circumferential portion of said liner when said upper section of said cap is rotated over said orifice, said ramp means includes:

a first protrusion which extends outwardly from said inner surface of said cylinder onto said upper surface of said partition, said first protrusion including a first wall parallel to said inner surface of said cylinder, second and third walls extending from said inner surface to said first wall, said second and third walls having an angle with respect to one another, a fourth wall extending along an edge of said first wall that is parallel to said upper surface, said fourth wall extending at a thread angle with respect to said partition, said thread angle being generally equal to an angle on said threads of said bottle; and said puncture means includes a second protrusion extending outwardly from said upper surface of said partition, said second protrusion including a puncture point for initially contacting and puncturing said liner, said puncture point having a height less than the height of said fourth wall with respect to said partition to cause said cutting surface to disengage from a circumferential portion of said liner as said upper portion of said cap is rotated over said liner.

8. A method of puncturing a liner of an orifice of a bottle having threads with a cap having a cylinder having an inner surface, the cap having a partition dividing the cylinder into upper and lower sections the partition having an upper and lower surface, the cap also having threaded means for securing the cap to the bottle, the threaded means being located on the inner surface of the cylinder on the lower section, the cap also having a puncture means for circumferentially puncturing the liner as the upper section of the cap is rotated over the orifice, the puncture means being located on the upper surface of the partition, the cap also having a ramp means for contacting the threads as the upper section of the cap is rotated over the orifice to cause the puncture means to refrain from puncturing a portion of the circumference of the liner, comprising the steps of:

first, forcing said puncture means into said liner; and second, rotating said cap in either direction over said liner to cause said ramp means to ride along an uppermost thread of said bottle to cause said puncture means to circumferentially puncture a portion of said liner.

* * * * *